US006577488B1

(12) United States Patent
Seifert et al.

(10) Patent No.: US 6,577,488 B1
(45) Date of Patent: Jun. 10, 2003

(54) INDUCTIVE LOAD DRIVER UTILIZING ENERGY RECOVERY

(75) Inventors: Betty-Rose G. Seifert, Lake Villa, IL (US); James A. Freeman, Antioch, IL (US); Salvatore Albanese, Highland Park, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/484,107

(22) Filed: Jan. 14, 2000

(51) Int. Cl.[7] ..... H01H 47/00
(52) U.S. Cl. ..... 361/156; 361/160
(58) Field of Search ..... 361/156, 160, 361/115, 155, 152

(56) References Cited

U.S. PATENT DOCUMENTS

| | | | | |
|---|---|---|---|---|
| 4,507,569 A | * | 3/1985 | Hess, II | 307/130 |
| 4,595,975 A | * | 6/1986 | Gray, Sr. | 363/33 |
| 5,532,526 A | | 7/1996 | Ricco et al. | |
| 5,717,562 A | | 2/1998 | Antone et al. | |

* cited by examiner

*Primary Examiner*—Stephen W. Jackson
(74) *Attorney, Agent, or Firm*—Steven A. May; Thomas V. Miller

(57) ABSTRACT

An inductive load driver having an inductive load and a bridge circuit connected in parallel with the inductive load, wherein the bridge circuit generates a current to the inductive load that rapidly rises.

80 Claims, 15 Drawing Sheets

— PRIOR ART —

— PRIOR ART —

— PRIOR ART —

— PRIOR ART —

— PRIOR ART —

RECOVER FROM LOAD INTO CAPACITOR
(PHASE IIA)

DRIVE FROM BATTERY
(PHASE I)

FREEWHEEL WITH NO ENERGY TRANSFER (PHASE IIB)

DRIVE LOAD FROM CAPACITOR (BOOST) (PHASE I)

INDUCTIVE LOAD DRIVER UTILIZING ENERGY RECOVERY

BACKGROUND OF THE INVENTION

1. Field of the Invention

The present invention relates to an electronically controlled inductive load actuator, and more particularly an electronically controlled diesel fuel injector.

2. Discussion of Related Art

From the 1960's to the present there has been increasing awareness of the effect that vehicular emissions have on the environment. Accordingly, increasingly demanding emissions standards have been imposed on vehicles in a number of countries, including the United States.

One way that has been used in the past to control emissions in vehicles is to have an accurate knowledge and control of the start and stop of fuel injection as well as the amount of fuel delivery. One method of such control is to have a rapid rise/fall in current enabling the fuel injection valve to move from a closed to an open position in a very short predictable period of time. This allows for an accurate understanding of the start and stop of fuel injection. Also the faster the armature moves, the more accurate the prediction of fuel flow, especially with the demand for higher fuel rail pressures.

In the past, the rapid rise in current, if the vehicle battery could not provide it, was provided by a boost supply that comprised a capacitor that stored the energy required for the rapid rise in current. The power output of the boost supply and the choice in capacitance involved an understanding of the required current rise rate, load inductance and the minimum spacing between fuel injection events. The rapid fall in current was typically provided by turning off the injection driver abruptly by actively clamping the voltage across the load so as to rapidly dissipate the energy stored in the load. This energy was dissipated as a power loss in the circuit elements.

As shown in FIG. 1, a typical method of driving an inductive load is via a battery B. To drive the load L to a higher current level, both switches S1 and S2 are closed, and current flows from the battery B through S1, the load L, returning to ground via S2. To provide a slow current decay, S1 is then opened causing current to flow through diode D2 and S2. In the alternative, for a rapid decay in current, S1 and S2 are opened so that current flows from ground, through D2, the load L, and returns through diode D1 to the battery B. Note that it is possible to eliminate the diode D1 when the switch S2 operates like an FET or similar type switch so that the current flows from ground, through diode D2, through the load L and returns to ground through the switch S2 when the switch S2 is operating in an unsaturated/linear manner.

In another known structure shown in FIG. 2, the inductive load L is driven by a battery B and an independent boost supply. The output filter is represented by the boost capacitor C. For an initial rapid rise in current, switches S1 and S2 are both closed so that current will flow out of the boost capacitor C and through S1, the load L, returning to the capacitor C via S2. The load L can then be driven to a higher current level via battery B by opening switch S1 and closing switches S2 and S3 so that current flows from the battery B through S3, the load L, and returning to ground via S2. At this point, the current can either decay slowly or quickly. To provide a slow current decay, switch S2 is closed and switches S1 and S3 are opened so that current flows through diode D2 and S2. For a rapid decay in current, switches S1, S2 and S3 are all opened so that current flows from ground, through D2, the load L, and returns to ground through the switch S2 when the switch S2 operates like an FET or similar type switch and the switch S2 is operating in an unsaturated/linear manner.

There has become an increased need for multiple injection events on the same fuel injector during a given engine cycle. These multiple injection requirements add a burden to inductive load driver systems that use a boost supply in that the boost supply is required to provide a given amount of energy to the load repeatedly in rapid succession. For an independent boost supply to provide this energy, the power output requirements and therefore its cost, size, and power losses become excessive.

In an attempt to accommodate these multiple injection events using the known methods described above with respect to the inductive load driver systems of FIGS. 1 and 2, the supply providing the initial current rise may require a substantial power output capability. This is not an issue if the supply is a battery as with the inductive load driver system of FIG. 1. However, for the inductive load driver system of FIG. 2 that uses a separate boost power supply, this could have substantial impact on the design, such as increasing component sizes and costs.

One known way to get around the shortcomings of the inductive load driver system of FIG. 2 is to recovery energy from the load L. Two embodiments and methods for recovering energy from the load L are illustrated in FIGS. 3 and 4. In the embodiment of FIG. 3, when switch S3 is open, switches S1 and S2 are closed to cause current to flow out of the boost capacitor C through S1 so as to cause an initial rapid rise in current in the load L. The current is later returned to the capacitor C through ground via switch S2. To drive the load L to a higher current level through the battery B, switches S2 and S3 are closed while S1 is open. In this case, the current flows from the battery B through S3, the load L and returning to ground through S2. To provide a slow current decay, S2 is closed and S1 and S3 are open so that current flows through D2 and S2. For energy recovery from the load charging the boost capacitor C (which also provides for a rapid decay in current), S1, S2 and S3 are open, current flows from ground, through D2, the load, and returns to the boost capacitor C through D1.

In the embodiment of FIG. 4, an initial rapid rise in current in the load L is caused by closing switches S1 and S2 so that current will flow out of the boost capacitor C through S1, the load L, and returning to the capacitor C via S2. To drive the load to a higher current level through the battery B, switch S2 is closed while switch S1 is open. In this case, current flows from the battery B through diode D2, the load L, returning to ground through S2. To provide a slow current decay, S1 is closed with S2 open causing current to flow through S1 and D1. For energy recovery from the load L charging the boost capacitor C (which also provides for a rapid decay in current), S1 and S2 are open so that current flows from the battery B through D2, the load L, and returns to the boost capacitor C through D1.

Note that the embodiments of FIGS. 3 and 4 are such that the separate boost supply is eliminated and all of the energy required for the initial current rise may be derived from the load(s), since the loads are inductive in nature, and, thus, may be used as the inductive element of a boost supply. Of course, when the load is used for charging the boost capacitor C it is desirable to drive the load with a current that does not actuate the load.

The four methods of operating the prior inductive load driver systems of FIGS. 1–4 are summarized in the table below. In reading the table, the term $S2_{BD}$ denotes the situation when the switch S2 operates like an FET or similar type switch and the switch S2 is operating in an unsaturated/linear manner, i.e., the voltage is clamped to a high voltage during turnoff. The term "Recirculate/Freewheel" regards the current slowly decaying from the load due to a slow energy discharge with no energy transfer from the load. The term "Rapid Current Fall/Recovery" regards a rapid current decay from the load caused by a rapid energy transfer from the load to an energy storage device like a capacitor C.

The above aspect of the present invention provides the second advantage of using a single ended load, i.e., only the positive terminal of the load being connected to the driving circuit that allows the load to be grounded externally.

The above aspect of the invention provides another advantage of decreasing both harnessing requirements and the difficulty of assembly.

Further objects, advantages and details of the invention will become apparent from the ensuing description of an exemplary embodiment in conjunction with the accompanying drawings.

Summary of Prior Art

| Method | Battery Drive (FIG. 1) | Independent Boost (FIG. 2) | Boost With Energy Recovery FIG. 3 | Boost With Energy Recovery FIG. 4 |
|---|---|---|---|---|
| Rapid Current Rise Batt | Close S1, S2 | Close S3, S2<br>Open S1 | Close S3, S2<br>Open S1 | Close S2, D2<br>Open S1 |
| Rapid Current Rise Boost | N/A | Close S1, S2 | Close S1, S2 | Close S1, S2 |
| Rapid Current Fall (or Recovery) | D1, D2<br>Open S1, S2<br>or<br>D2, $S2_{BD}$<br>Open S1, S2 | D2, $S2_{BD}$<br>Open S1, S2, S3 | D1, D2<br>Open S1, S2, S3<br>or<br>Close S3, D3, D1<br>Open S1, S2 | D1, D2<br>Open S1, S2 |
| Slow Current Decay (Recirculate/Freewheel) | Close D2, S2<br>Open S1 | Close D2, S2<br>Open S1, S3 | Close D2, S2<br>Open S1, S3<br>or<br>Close S1, D1<br>Open S2, S3 | Close S1, D1<br>Open S2 |

Each of the above-described embodiments of FIGS. 1–4 is very similar in that they are each formed with a bridge where the middle element in the bridge is the load inductor. The addition of energy recovery involves maintaining the presence of D1 from the battery drive scheme with the addition of a boost capacitor.

Ignoring how the battery source is connected, the two energy recovery methods described above with respect to FIGS. 3 and 4 have the same topology as shown in FIG. 5. Driving the load from the capacitor C involves closing switches S1 and S2. Slow energy discharge with no energy transfer may be done either through D1, S1 or through D2, S2. Energy recovery or rapid energy transfer from the load to the storage capacitor C involves discharging the inductor into the capacitor through D1 and D2. There are at least two disadvantages to driving the load with this topology. For example, one disadvantage is that multiple current sensing elements are required or an alternate method for the prediction of current fall time while the capacitor is being charged (when current is flowing through D1 and S2 is open) is required since there is no one element that carries the load current at all times. A second disadvantage of the topology is that there is no means for having the load grounded externally, or directly to the engine block so that harnessing requirements increase and assembly is made more difficult so that costs increase.

SUMMARY OF THE INVENTION

One aspect of the present invention regards an inductive load driver having an inductive load and a bridge circuit connected in parallel with the inductive load, wherein the bridge circuit generates a current to the inductive load that rises.

The above aspect of the present invention provides the advantage of improving the ease of current sense.

DESCRIPTION OF THE PREFERRED EMBODIMENT

Figure 1:
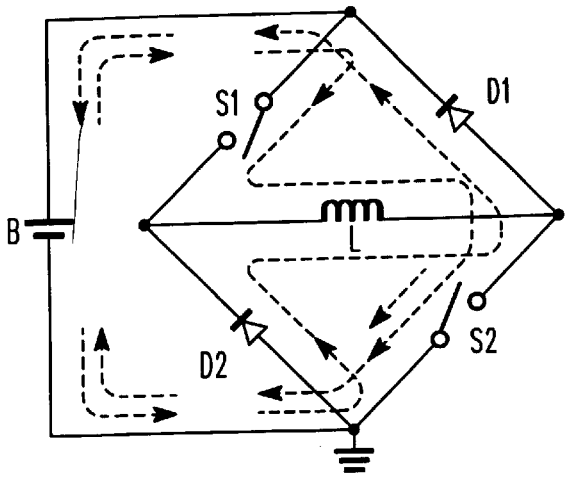
FIG. 1 shows a circuit diagram of a prior known circuit for driving an inductive load with a battery.
Figure 2:
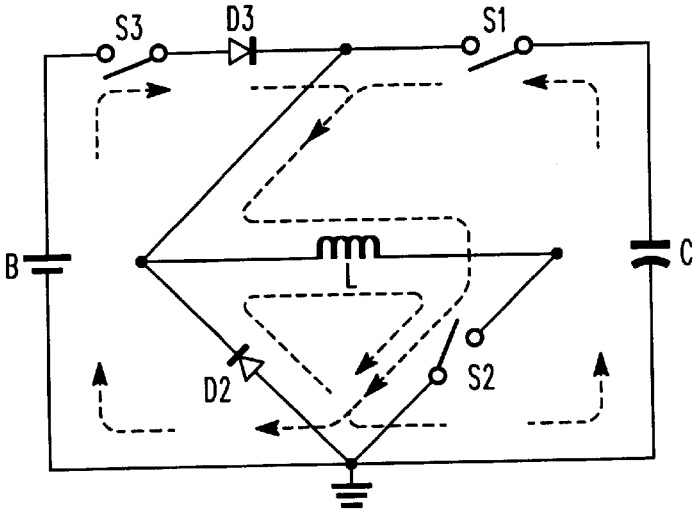
FIG. 2 shows a circuit diagram of a prior known circuit for driving an inductive load with an independent boost supply.
Figure 3:
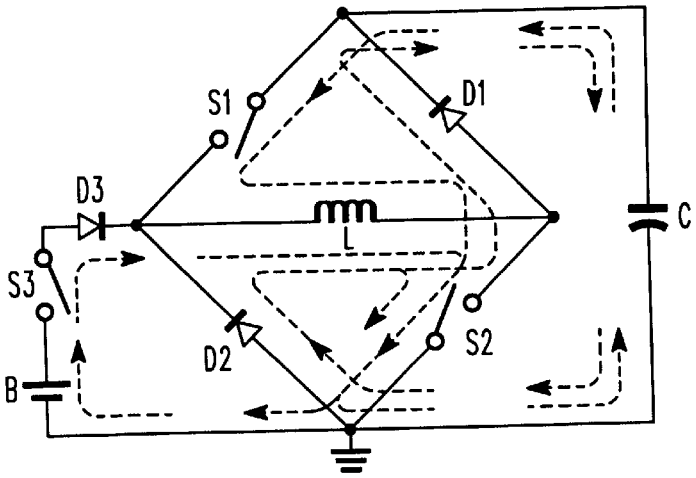
FIG. 3 shows a circuit diagram that demonstrates a prior known method of recovering energy from an inductive load.
Figure 4:
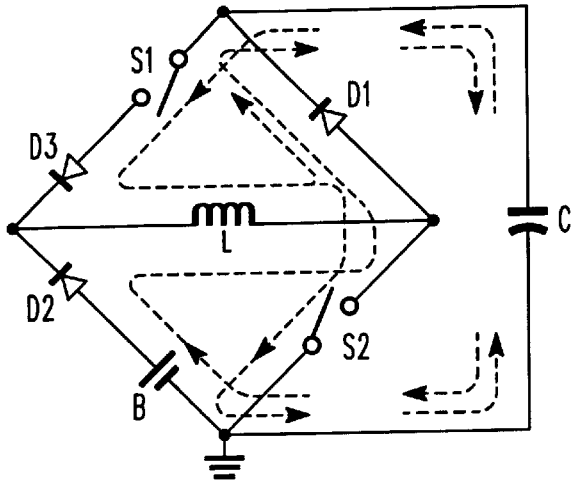
FIG. 4 shows a circuit diagram that demonstrates a second prior known method of recovering energy from an inductive load.
Figure 5:
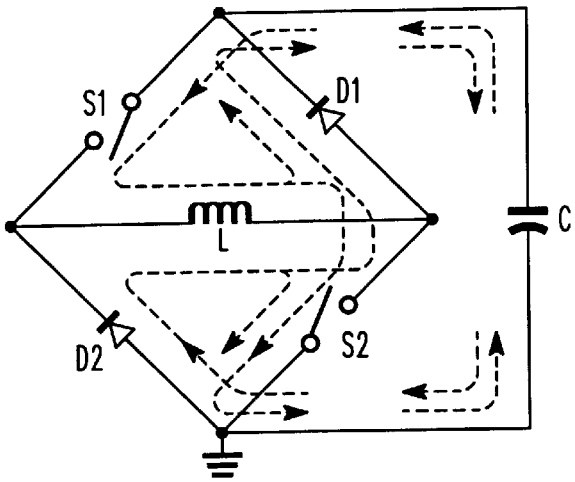
FIG. 5 shows the circuit diagram of FIGS. 3 and 4 where the voltage source has been removed.
Figure 6:
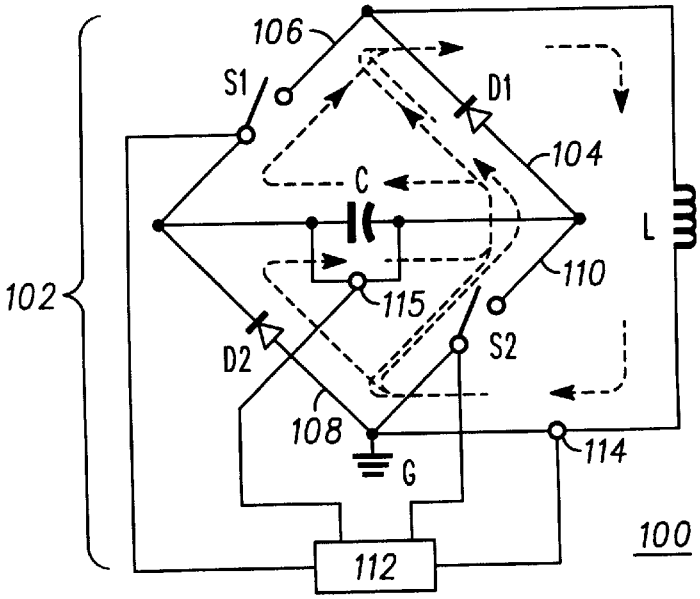
FIG. 6 shows a circuit diagram that illustrates a first embodiment of the present invention where the voltage source is absent.

In order to better understand how the general circuit topology of an inductive load driver according to the present invention operates independent of how the independent voltage source is connected, the independent voltage source used is not shown in FIG. 6. The inductive load driver 100 includes an inductive load, L, that is connected in parallel to a bridge circuit 102. The bridge circuit 102 has four legs 104, 106, 108, 110 where two opposing legs 104, 108 have diodes D1 and D2 and the other opposing legs 106, 110 have switches S1 and S2. An energy storage element, such as capacitor C, is located in the middle of the bridge circuit 102. The capacitor C has a capacitance that is determined by the load requirements and boost voltage chosen, such as in the range of 15 to 120 $\mu$F. The diodes D1 and D2 can be Schottky or ultrafast diodes and the switches S1 and S2 can be MOSFETS. The inductive load L has an inductance of in the range of 125 $\mu$h to 1 mh and is permanently attached directly or indirectly to ground G, a common reference voltage line.

Note that the load L may be any load that has an inductance but preferably is a diesel fuel injector or an electromagnetically actuated load. In addition, while the circuits 100 described below are preferably used for fuel injectors it can be applicable as a generic flyback energy power supply.

The inductive load L is driven by the bridge circuit 102 by controlling the opening and closing of the switches S1 and S2 by a controller 112, such as a MPC555 microprocessor manufactured by Motorola, Inc. Besides the switches S1 and S2, the controller 112 is connected to one or more detectors, such as a current sensor 114 and a voltage sensor 115, that continuously measures one or more parameters of the load L and the capacitor C, such as the voltage of the capacitor C or the current flowing through the load L. The controller 112 opens and closes the switches S1 and S2 based on the measured parameter.

Figure 7:
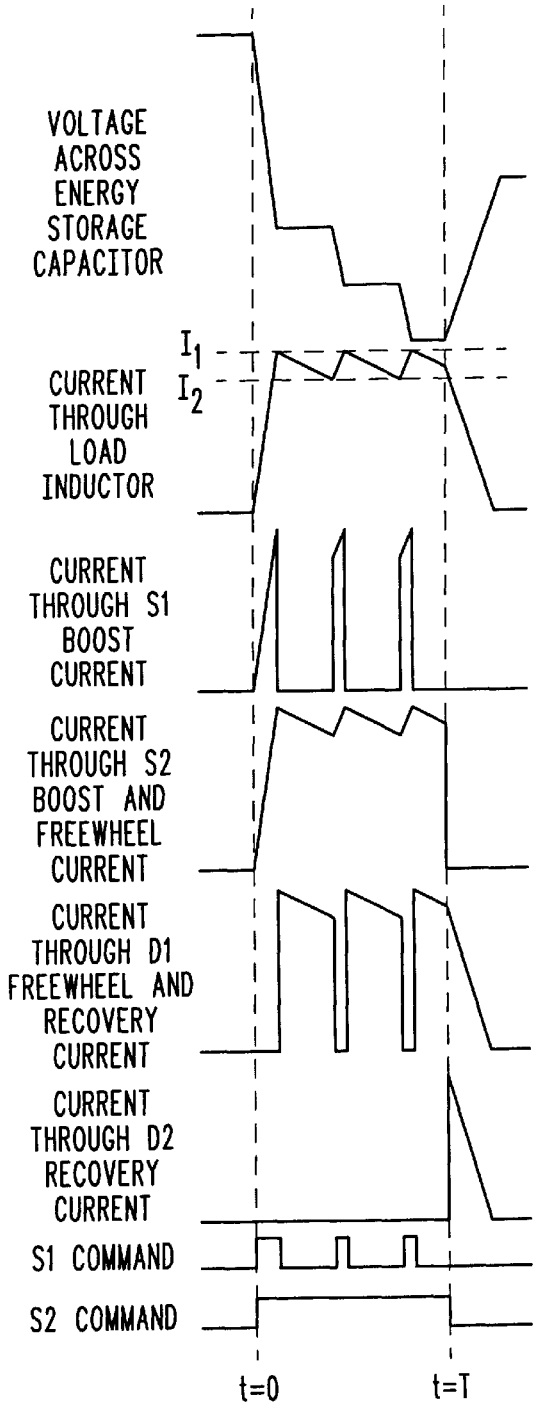
FIG. 7 shows a timing diagram for the circuit of FIG. 6.

A possible way of operating the inductive load driver of FIG. 6 is shown in FIG. 7. Assuming the capacitor is fully charged at time t=0, when switches S1 and S2 are simultaneously closed at t=0 the current through the load L rapidly rises in less than approximately 200 $\mu$s from a valley (or zero) to a predetermined peak value, $I_1$, having a value in the range of 15 to 25A. When the detector 114 detects that the peak current, $I_1$, has been reached, then the controller 112 opens the switch S1 causing the load L to slowly lose energy through switch S2 and diode D1 while the charge of the capacitor C remains constant. When the detector 114 detects that the current of the load L falls to a second predetermined value, $I_2$, that is approximately 2 to 3A below $I_1$, switch S1 is again closed until the current flowing through the load L again rises to the peak value, $I_1$. The process is repeated until the charge of the capacitor C reaches 0, or the fuel injector is commanded off at time T. At this point in time, switch S2 is also opened causing the current through the load L to rapidly fall to a valley (or zero) in less than about 50 $\mu$s. While the current through the load falls, the capacitor C is recharged to an intermediate level determined by the energy recovered from the load. The energy recovered from the load is typically 30% to 60% of the energy delivered in the initial current rise.

Figure 8:
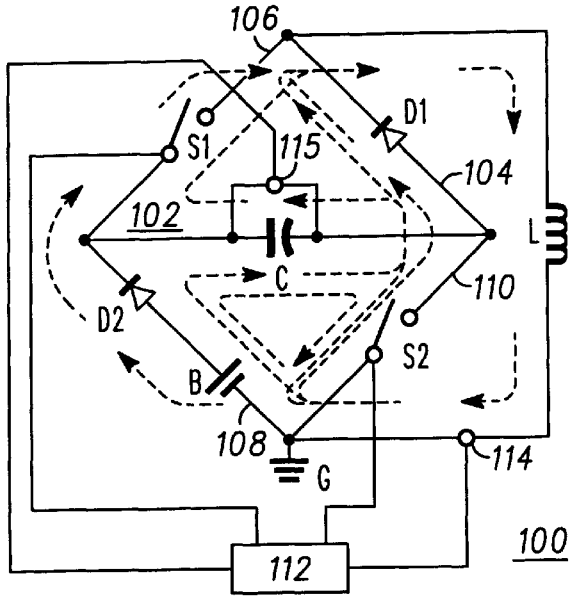
FIG. 8 shows a circuit diagram that illustrates a second embodiment of the present invention.

There are several ways to boost the voltage and charge of the capacitor C to its original value at t=0s. One way is to insert a high voltage source, such as an automotive 12V or 24V battery B, in the leg 108 of the bridge circuit 102 as shown in FIG. 8. In this case, the inductive load driver 100 may be driven in any combination of the five modes shown in FIG. 8. Those five modes are: 1)–Boost & Freewheel, 2) Boost/Battery Drive & Recover, 3) Boost & Battery Constant Drive, 4) Boost/Battery Drive & Freewheel and 5) Capacitor Recharge. Each of those modes are discussed below.

Figure 9:
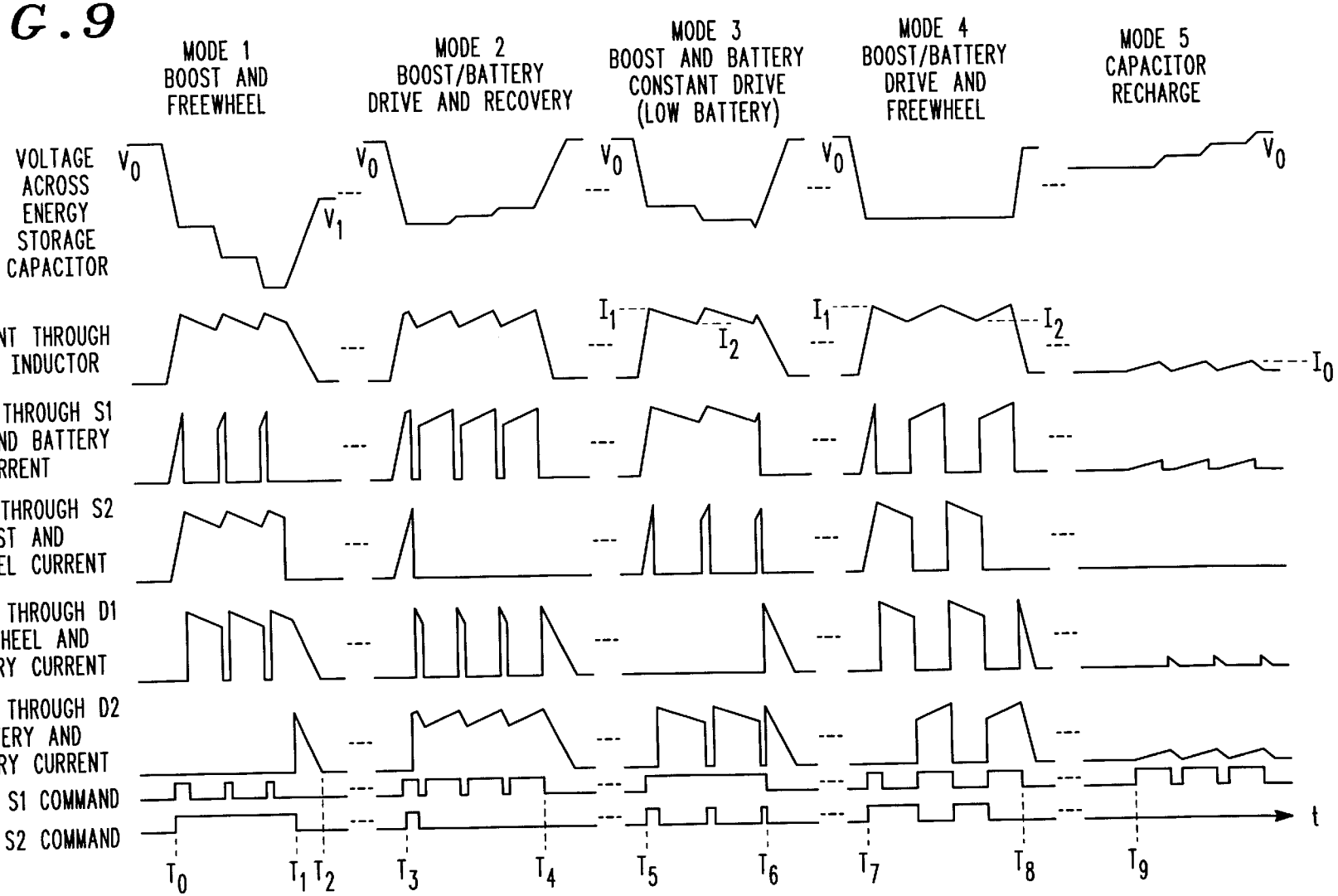
FIG. 9 shows a timing diagram for the circuit of FIG. 8.

The first mode of operation is performed in the same manner as the Boost & Freewheel mode of operation illustrated in FIG. 7 for the inductive load driver 100 of FIG. 6 to provide a rapidly rising and falling load current. As with the inductive load driver 100 of FIG. 6, the capacitor C of FIG. 8 is recharged as shown in FIG. 9 at the termination of the command closing the switch S2. The charge on the capacitor C does not fully reach the initial charge on the capacitor due to electrical and mechanical losses in the load and related circuitry. Therefore, the recharged voltage level V1 at time t=T2 is less than the original charge voltage level $V_0$.

In the second mode of operation, switches S1 and S2 are simultaneously closed at t=T3. Closing the switches causes the capacitor C to discharge and the current of the load L to rapidly rise in a manner similar to that described previously. In order to recharge the capacitor C during the second mode of operation to the initial charge voltage $V_0$, the switches S1 and S2 are opened by the controller 112 when the detector 114 measures a peak value for the load current. Switch S2 remains open while switch S1 is opened and closed a number of times. At those times when the switch S1 is closed, the battery B boosts the current in the load. The boosted load current then charges the capacitor C so that the voltage of the capacitor increases in steps when the switch S2 is opened. The termination of the injection/command pulse, the period of time in which the injector is commanded, occurs at time t=T4. If it is expected that the capacitor voltage will rise above the desired initial value, $V_0$, then prior to the termination of the injection pulse, the controller 112 should switch to the fourth operating mode. The termination of the injection pulse is independent of the charging characteristics of the capacitor C but rather is determined by the fueling requirements of the engine. In addition, the pulse width is determined by the controller 112 based on engine parameters, such as RPMs, the throttle and fuel pressure, to generate the control signals, that are measured by external sensors in a well known manner.

During the third mode of operation, the switches S1 and S2 are simultaneously closed causing a rapid rise in the load current again. In this mode of operation, the switch S1 remains closed while the switch S2 is opened and closed to maintain the load current between levels $I_1$, and $I_2$.

A fourth mode of operation is shown in FIG. 9. In this mode, switches S1 and S2 are simultaneously closed by controller 112 at time t=T7 in order to achieve a rapid rise in the current in the load L. When the peak current, $I_1$, is reached, the load current is allowed to decay with no energy transfer between the load L and the capacitor C (freewheel) by opening switch S1 while switch S2 remains closed. Upon decaying to the valley current, $I_2$, the battery B is switched into the circuit by closing the switch S1 simultaneously with the opening of the switch S2. Switches S1 and S2 are then alternately pulse width modulated to achieve a current in the load L that alternatingly rises to the peak current, $I_1$, through the battery B and decays slowly to the valley current, $I_2$, through ground G until the termination of the injection/command pulse width at time t=T8 as determined by the controller 112. At time t=T8, both switch S1 and switch S2 are opened for a rapid load current decay which results in the capacitor C being charged to a voltage level that is less than the initial value $V_0$.

If at the termination of the injection pulse either the capacitor C is not charged to the desired initial voltage, $V_0$, or the capacitor C is not at another desired voltage, the capacitor C can be recharged to the desired voltage by employing either the second mode of operation discussed previously or by using the fifth mode of operation. The second mode of operation is employed when the fuel injector is firing. The fifth mode of operation is employed when the fuel injector is not firing.

In the fifth mode of operation, switch S1 is turned on and switch S2 is turned off. The inductive load L is slowly charged through the battery B to a low current level, $I_0$, where the low current level $I_0$ is chosen so that the valve of the fuel injector will not be actuated. When the current $I_0$ is reached, the switch S1 is turned off and the load current is discharged into the capacitor C. the switch S1 is then turned on again and the load L is charged. When the load current reaches $I_0$, the switch S1 is turned off. The process is repeated until the capacitor C is charged to the desired initial voltage of $V_0$.

The fifth mode of operation is usually employed when there are multiple loads being used such as shown in FIGS. 14–21. In these cases, a load, such as a fuel injector, is fired in one of the banks of loads while the loads in the other bank are in a low current mode such as shown in mode 5. While the load is being fired, the low current loads recharge the common capacitor in a step wise fashion per the process described above with respect to mode 5.

Figure 10:
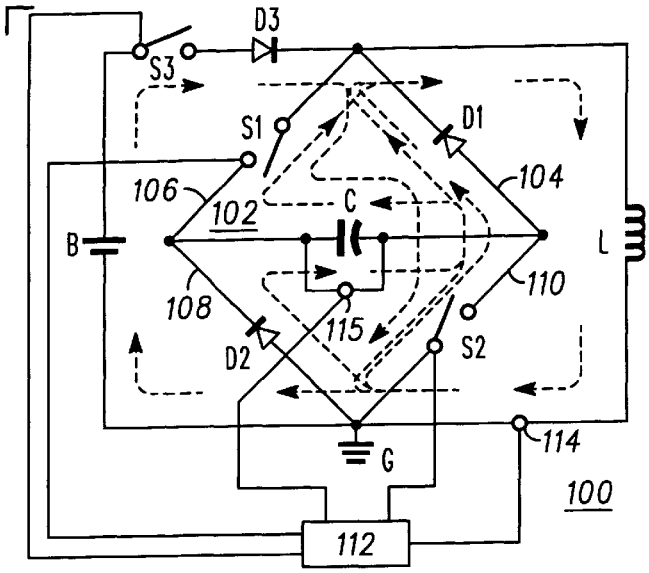
FIG. 10 shows a circuit diagram that illustrates a third embodiment of the present invention.
Figure 11:
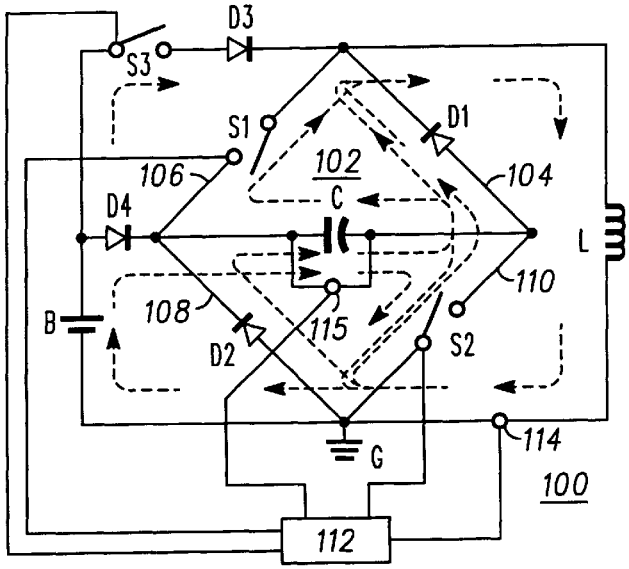
FIG. 11 shows a circuit diagram that illustrates a fourth embodiment of the present invention.
Figure 12:
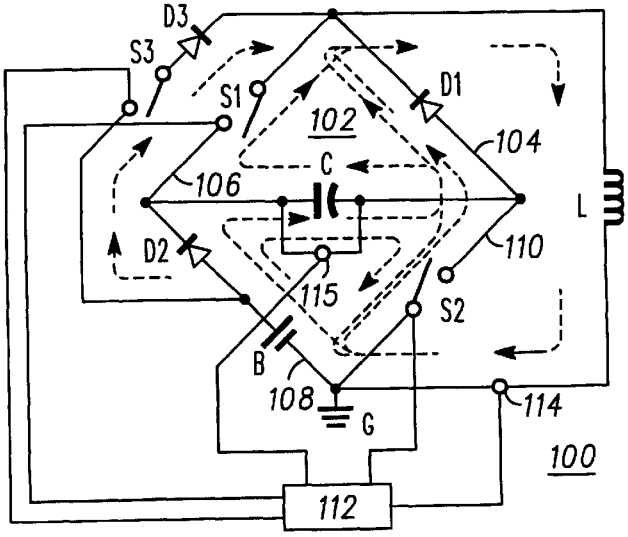
FIG. 12 shows a circuit diagram that illustrates a fifth embodiment of the present invention.

Three other embodiments for driving the inductive load L are shown in FIGS. 10–12 where elements S1, S2, D1, D2, C and L are the same as the circuit of FIG. 8. In the embodiment of FIG. 12, a switch S3 and diode D3 are added to the bridge circuit of FIG. 8. In the embodiments of FIGS. 10 and 11, the battery B is taken out of the bridge circuit 102 and connected in parallel to the bridge circuit 102. A third switch S3 is added to the bridge circuit 102 of FIGS. 10 and 11 with either one diode (FIG. 10) or two diodes (FIG. 11) connected to nodes of the bridge circuit 102.

Figure 13:
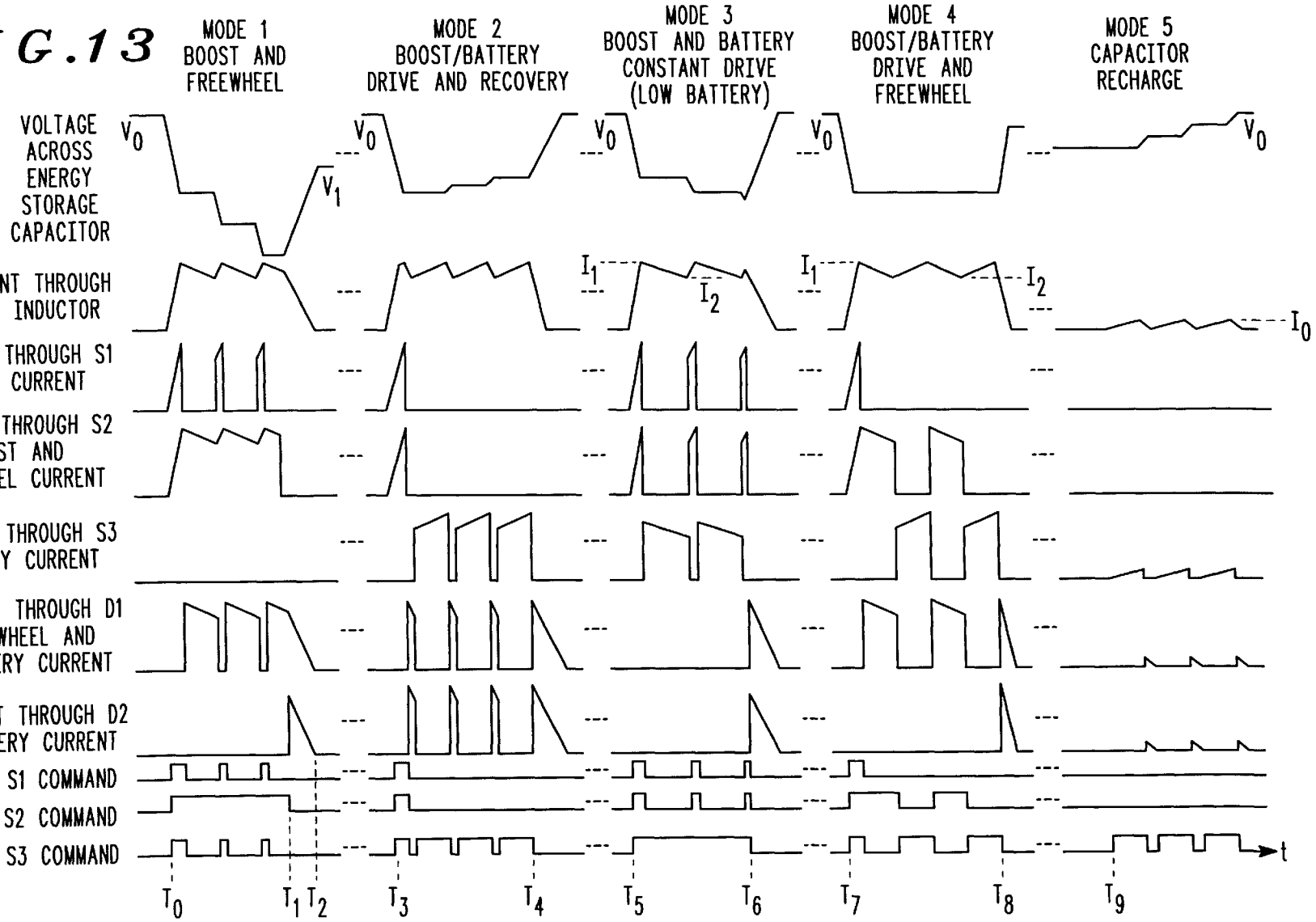
FIG. 13 shows a timing diagram for the circuits of FIGS. 10–12.

The timing diagrams for each of the circuits of FIGS. 10–12 are identical to one another where one such diagram is shown in FIG. 13. Comparing the timing diagram of FIG. 13 with the timing diagram of FIG. 9 shows that the circuits of FIGS. 10–12 produce an identical capacitor voltage and load current profile as the circuit of FIG. 8.

Having the battery B of FIGS. 10–12 connected in series with the inductive load L when switch S3 is closed and switch S1 is open results in a step-like recharging of the capacitor C during the boost & recover and capacitor recharge phases when switch S3 is opened and closed in the same manner that switch S1 is opened and closed in the same phases for the circuit of FIG. 8.

Figure 23:
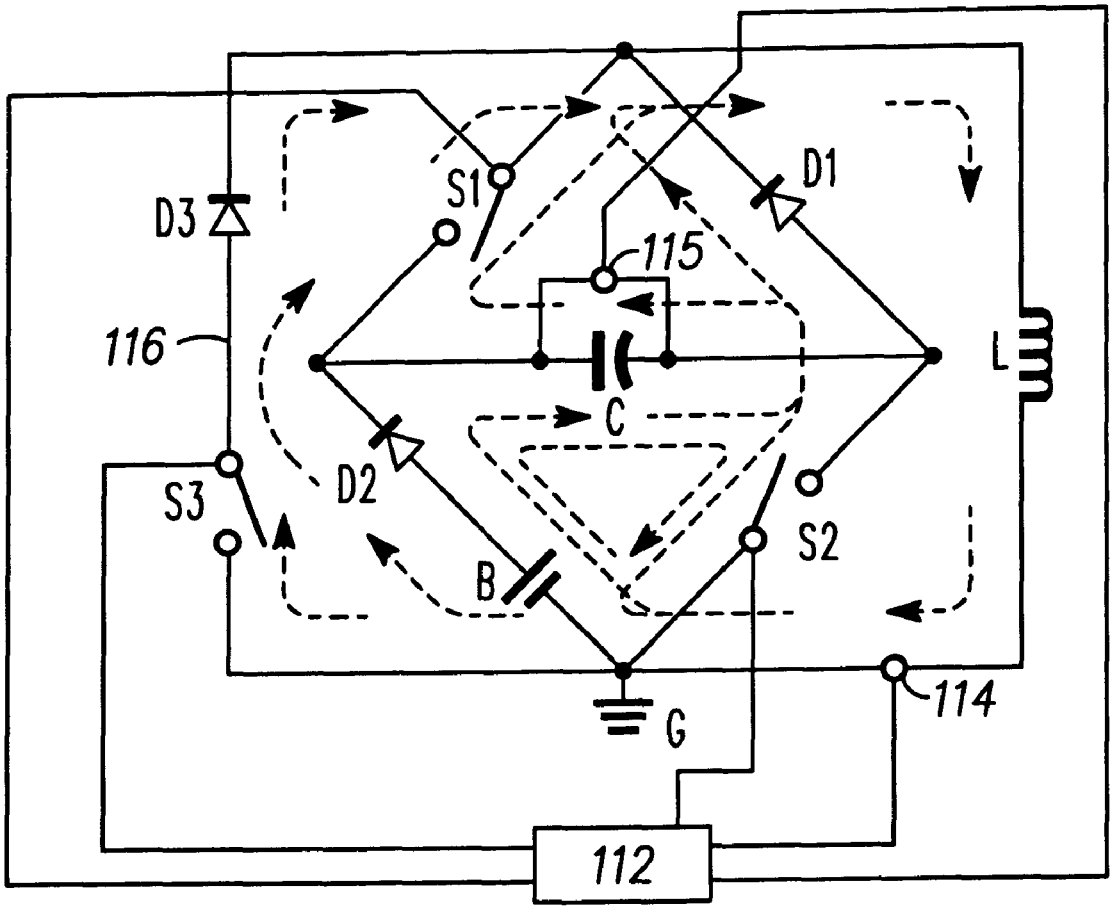
FIG. 23 shows a circuit diagram that illustrates an eleventh embodiment of the present invention.

Yet another embodiment for driving the inductive load L according to the present invention is shown in FIG. 23 where elements S1, S2, D1, D2, C and L are the same as those used in the bridge circuit 102 of FIG. 8. However, instead of adding these components in series with the battery B as in FIGS. 10–12, the components are arranged in parallel with the bridge circuit 102 and the load L.

Figure 24:
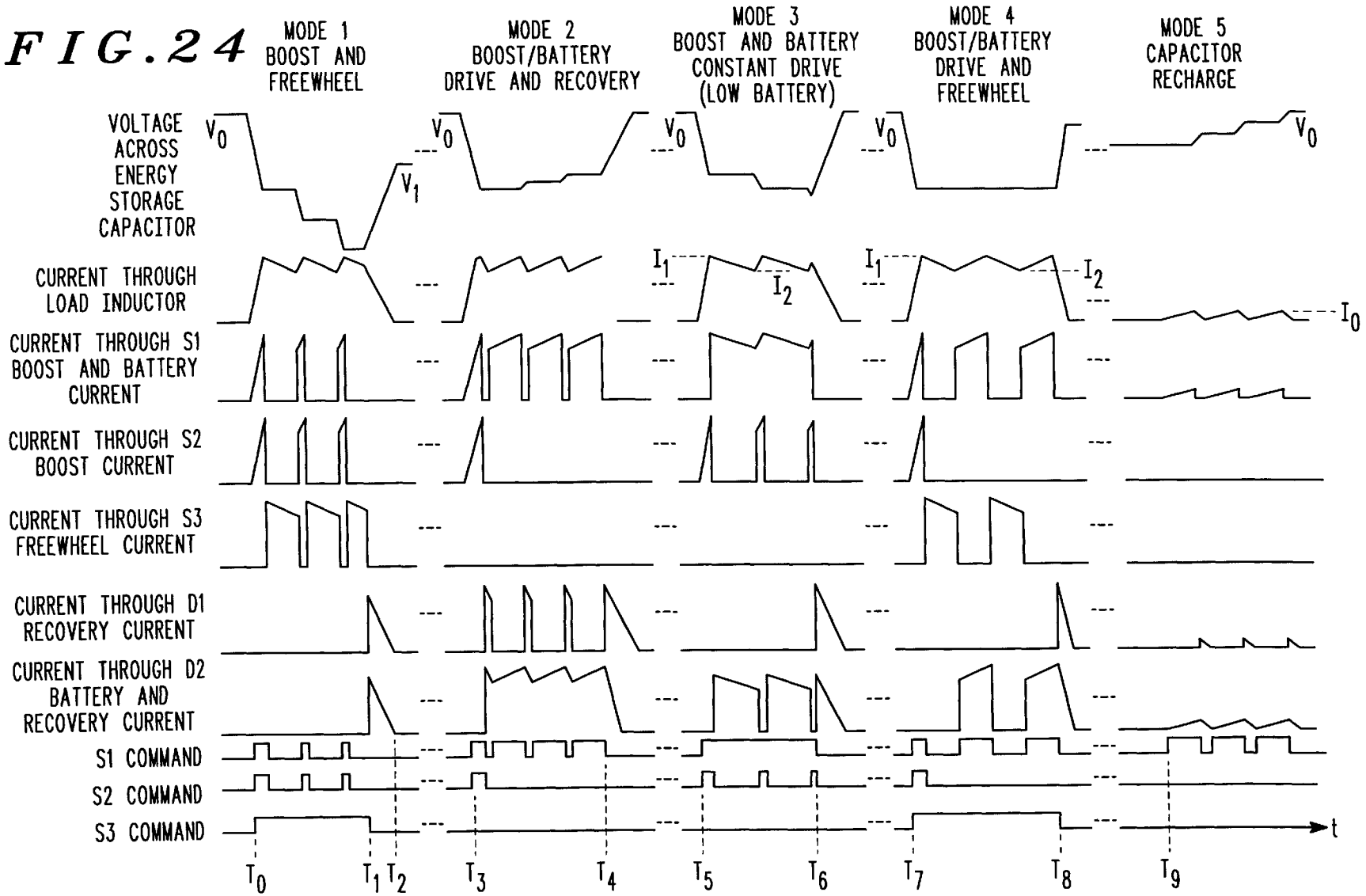
FIG. 24 is a timing diagram for the circuit illustrated in FIG. 23.

The timing diagrams for the five modes of operation of the circuit of FIG. 23 are shown in FIG. 24. Comparing the timing diagrams of FIGS. 24 and 8 shows that the circuit of FIG. 23 can produce capacitor voltage and load current profiles that are identical to that of the circuit of FIG. 8. The addition of the parallel leg 116 of FIG. 23 provides for a less complex switching waveform when operating in mode 4. While switch S2 in FIG. 8 performs the dual functions of 1) switching in the capacitor C and 2) turning on so as to cause across the load to be very low when freewheeling or slow energy discharge is required. The dual functions of the switch S2 of FIG. 8 have been split between the switches S1 and S2 of the circuit of FIG. 23 where switch S1 performs the function of switching the capacitor C in and out of the circuit while switch S2 performs the function of switching in when slow energy discharge is required.

Figure 14:
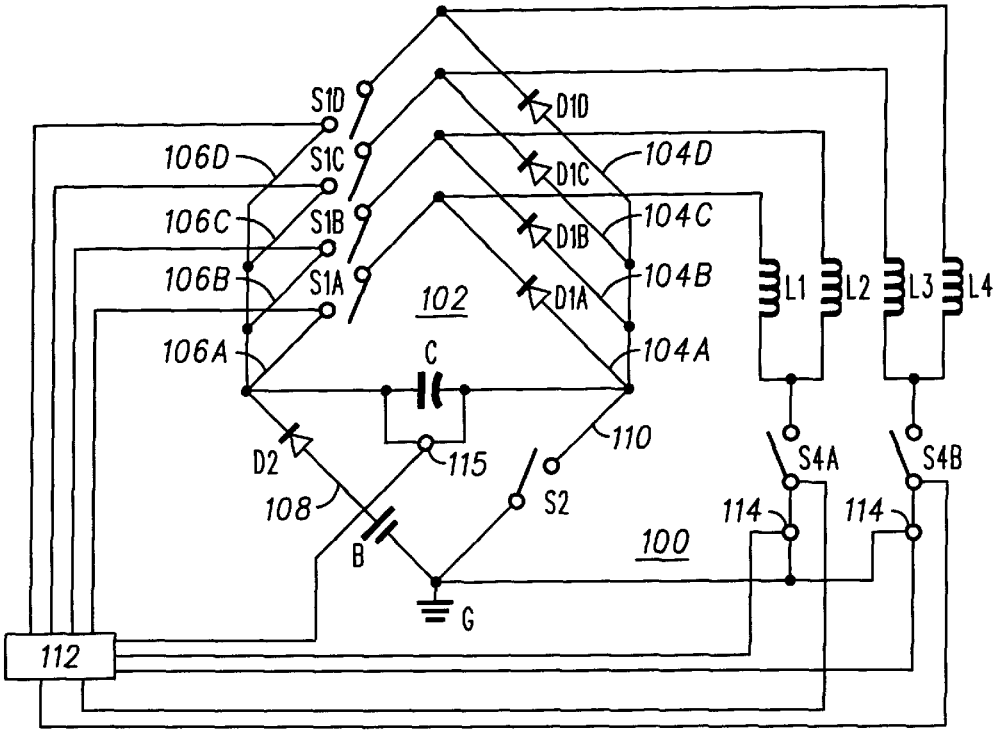
FIG. 14 shows a circuit diagram that illustrates a sixth embodiment of the present invention.
Figure 15:
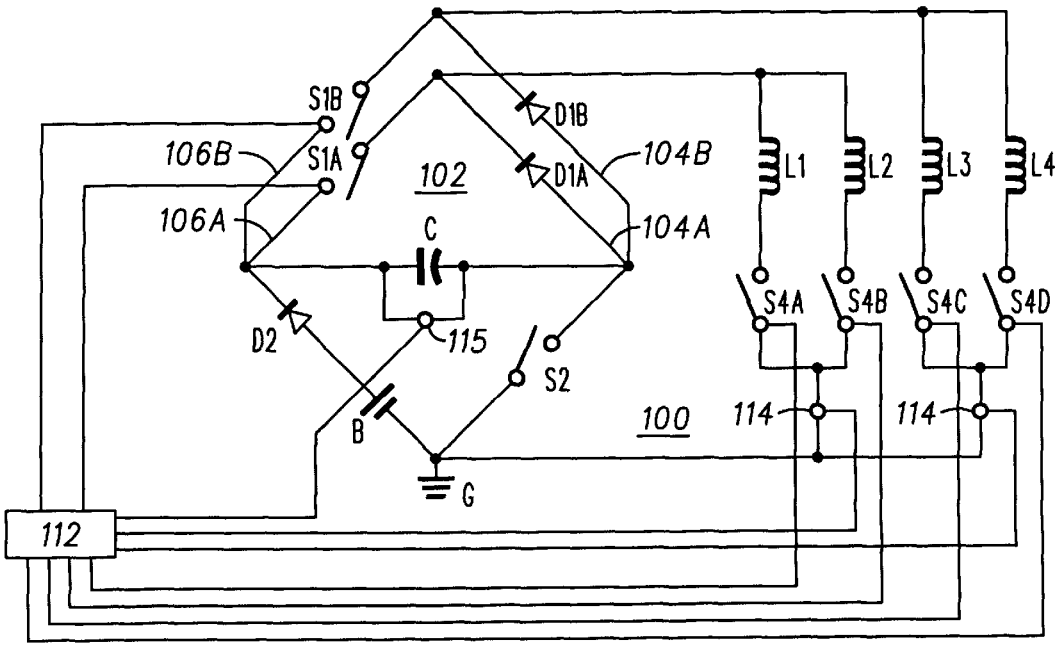
FIG. 15 shows a circuit diagram that illustrates a seventh embodiment of the present invention.
Figure 16:
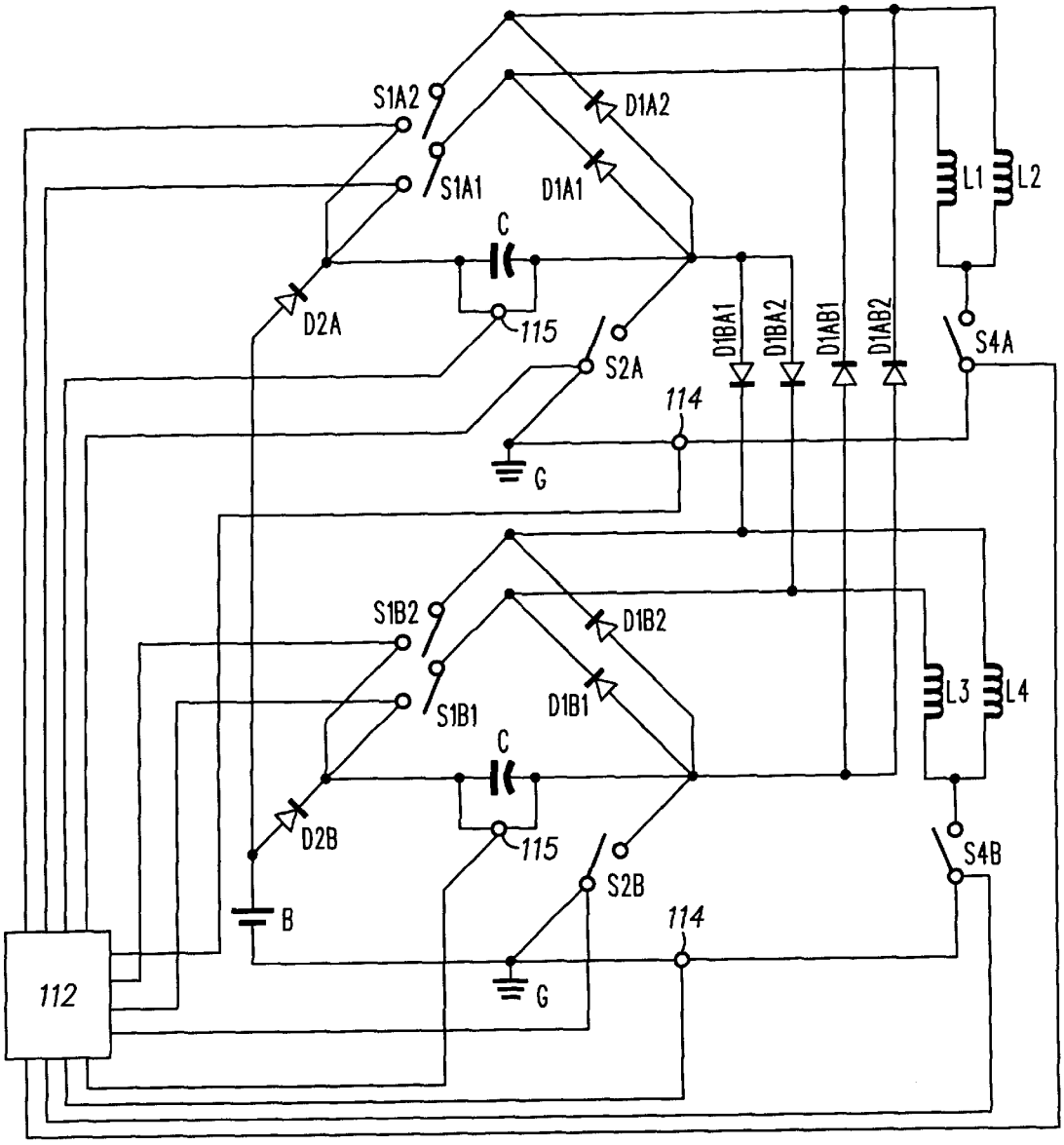
FIG. 16 shows a circuit diagram that illustrates an eighth embodiment of the present invention.
Figure 17:
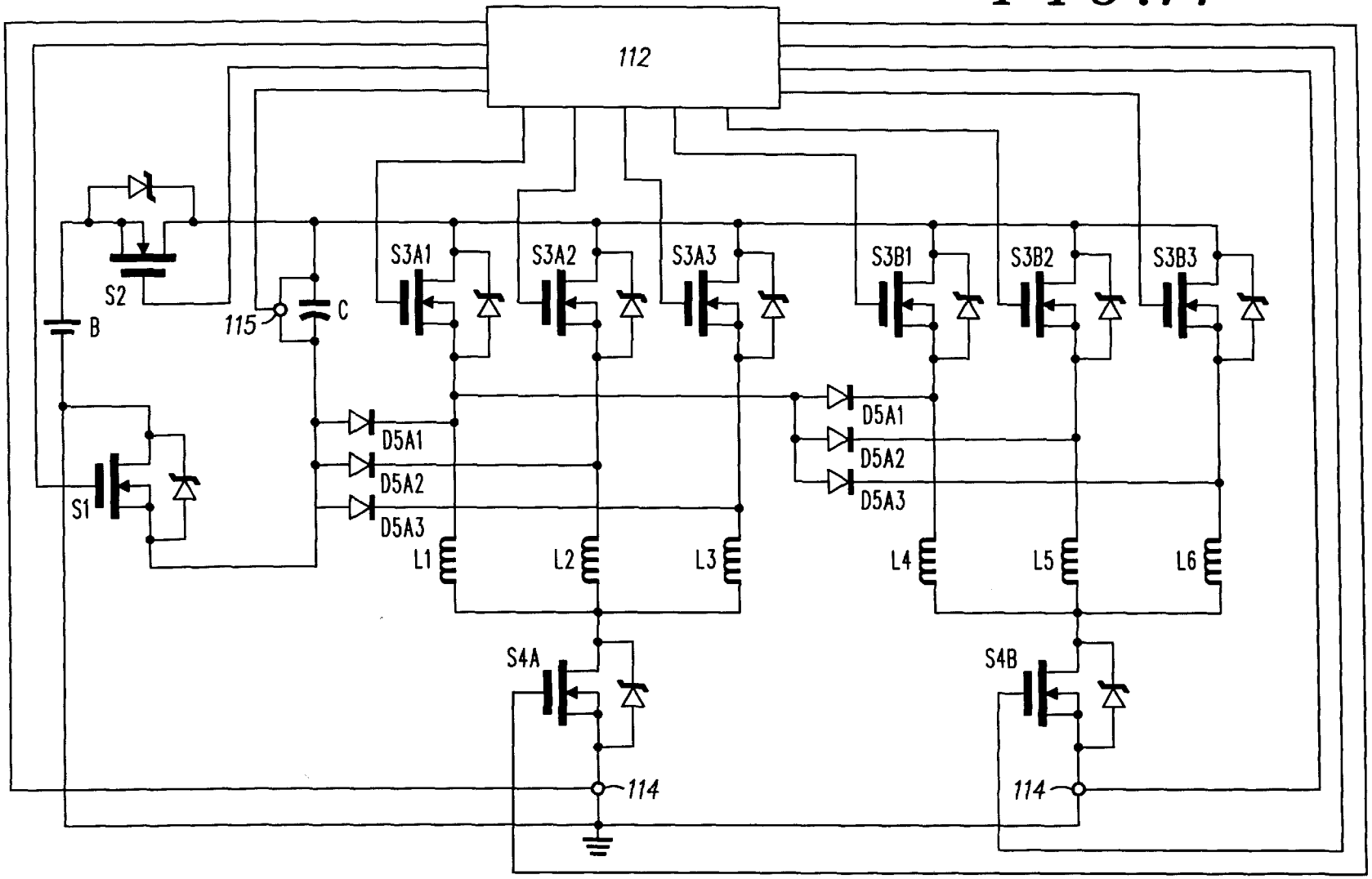
FIG. 17 shows a circuit diagram that illustrates a ninth embodiment of the present invention.

The above described circuits of FIGS. 6, 8, 10–12 and 23 show the situation where a single load is driven by the bridge circuit alone or in combination with an independent voltage source, such as the battery B. As shown in FIGS. 14–17, multiple loads of two, four, six or more may be connected common high side (FIGS. 15, 16) or common low side (FIGS. 14, 17). For multiple loads, any of the battery connection schemes of FIGS. 8, 10–12 or 23 may work, however for the sake of simplicity, only the first method of battery connection of FIG. 8 is shown. The multiple load diagrams of FIGS. 15 and 17 show switches S4A and S4B that are used for load selection for common high side and would be purely redundant in the common low side scheme and so are not required. As with the previous embodiments, the loads are preferably fuel injectors. The switches S are opened in response to control signals received from the controller 112 that monitors various parameters of the engine, such as RPMS, the throttle and fuel pressure, to generate the control signals. In certain circuit topologies, while only one fuel injector load L is fired at any one time in one bank of loads, one or more of the fuel injectors in the other bank may be simultaneously fired so as to recharge their capacitors.

A step-by-step review of how the sequence of opening the switches may be used to drive the inductive load is given below with respect to the embodiment of FIGS. 18–21. For the sake of clarity, the driving of the inductive load L2 will be described below. Consequently, load L1 is eliminated from the circuit by leaving switches S3A and S4A open throughout the process described below.

Figure 20:
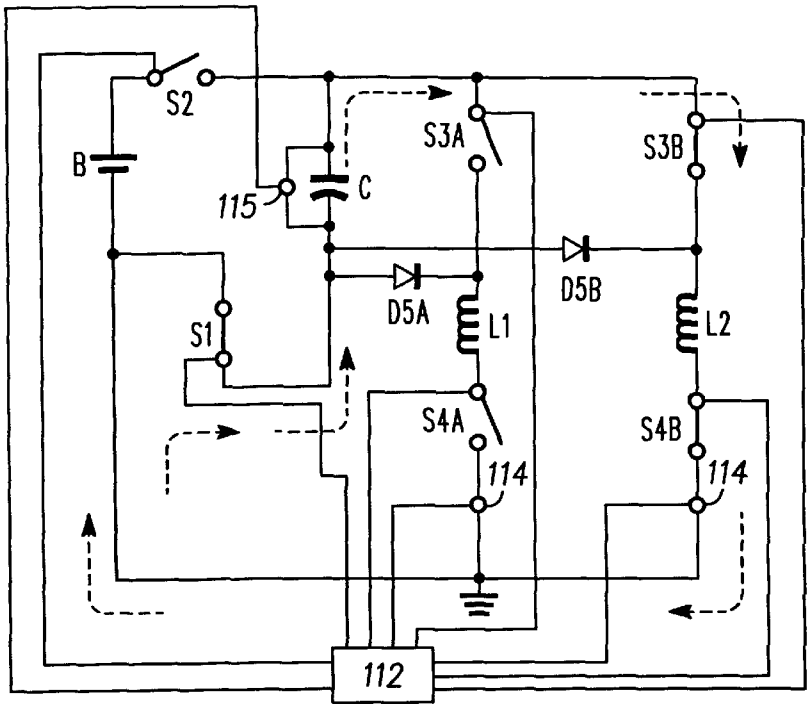
FIG. 20 shows the circuit diagram of FIG. 18 when the load is driven by the capacitor during a pull in phase.

With that said and assuming the capacitor has previously been initialized with a charge producing voltage, $V_0$, the start of an injection command is received and the initial rapid current rise is accomplished by closing switches S1, S3B and S4B while S2 is open, as illustrated in FIG. 20. This marks the beginning of the "Pull In" phase. In this illustration, it is assumed that the battery voltage is such that it is not capable of sustaining the required "Pull In" current levels. Therefore, during the "Pull In" phase, the switches S1 and S2 are opened and closed out of phase with one another so that the load is driven either from the battery (FIG. 18) or the capacitor (FIG. 20) where no energy is recovered in either case.

Figure 19:
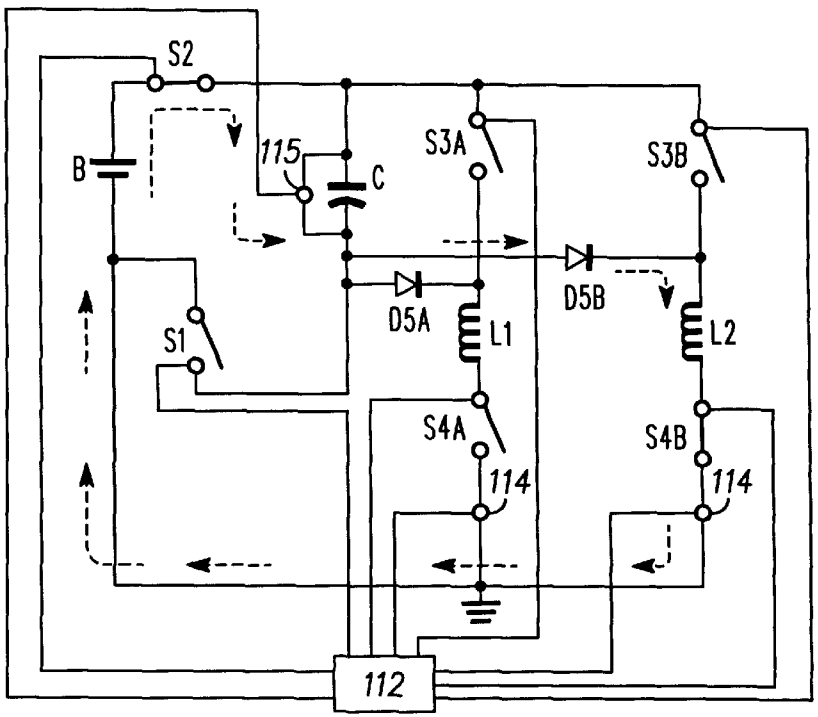
FIG. 19 shows the circuit diagram of FIG. 18 when energy is recovered from the load into the capacitor during a hold phase.
Figure 18:
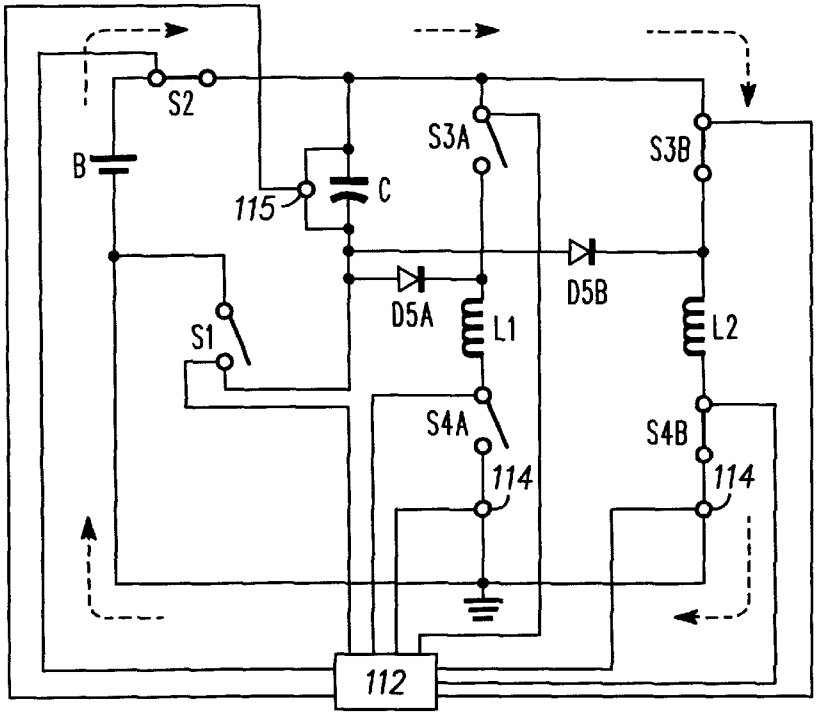
FIG. 18 shows a circuit diagram that illustrates a tenth embodiment of the present invention where the FETS of FIG. 17 are replaced by switches and the circuit is initially charged or when the load is driven from a battery during a pull in or hold phase.

When the "Pull In" time period has expired, typically 200 $\mu$s to 1 ms depending on the load, the controller sends a signal to the switches causing S2 and S4B to close while S1 and S3B are opened. This causes the current to discharge from the load L2 so that an amount of energy (i.e., voltage) is recovered by the capacitor C through the path S4B, battery B, S2, capacitor C and diode D5B as illustrated in FIG. 19. These switches are held in these positions until the current detector 114 indicates the current through the load has decayed to the appropriated current levels and the "Hold" phase begins.

In this illustration, it is assumed that the battery voltage, although too low to sustain the current levels required for "Pull In," is high enough to sustain the levels required for the "Hold" phase. Therefore, during the initial part of the "Hold" phase A, in the case of driving the inductive load L2 with the battery B, the switches S2 and S4B remain closed, switch S1 remains open and switch S3B is opened and closed as shown in FIG. 19 and the initial "Hold" phase II of the timing diagram of FIG. 22. Closing the switch S3B with switch S1 open and switches S2 and S4B closed causes the current in the load to rise, and the opening of the switch S3B causes the current to fall where the capacitor C recovers voltage and charge in a step-wise fashion.

Figure 21:
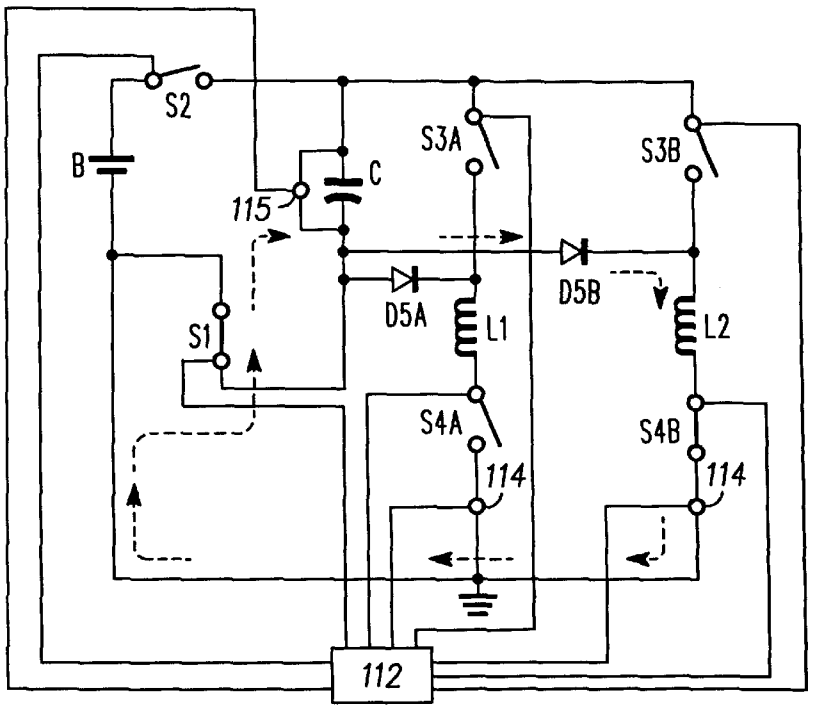
FIG. 21 shows the circuit diagram of FIG. 18 when freewheeling is performed with no energy transfer during a hold phase.

Later in phase II, the load is still driven by the battery B but without energy recovery by keeping switch S4 closed, opening and closing switches S2 and S3B in unison with one another and opening and closing switch S1 180 degrees out of phase with the opening and closing of switches S2 and S3B as shown in FIG. 21. Increases in the load current occur when switches S2 and S3B are closed and switch S1 is open as shown region B of phase II shown in FIG. 22. Decreases in the load current occurs when switches S2 and S3B are open and switch S1 is closed as shown in FIG. 23. Note that the average load current during phase I is higher than that in phase II because higher currents are needed initially during injection to overcome inertial forces initially present in the fuel injector while phase II has lower average current values for keeping the valve of the fuel injector in the actuated position.

Since the load L that has fired will also be used to recharge the capacitor C, a "dead time" phase III is recommended to allow all transients of the electro-mechanical system (i.e., fuel injector, valve and solenoid, inclusive) to dissipate. Accordingly, at the end of phase II, switches S1 and S3 are opened and switches S2 and S4 are closed so that the current through the inductive load rapidly decreases while the capacitor C is rapidly charged at the end of injection, thus beginning the "dead time" phase III of the cycle. When the current through the load L has dissipated to zero as measured by the detector 114, switches S2 and S4 are opened causing the current through the load to remain a minimum while the voltage of the capacitor remains at a constant value.

Figure 22:
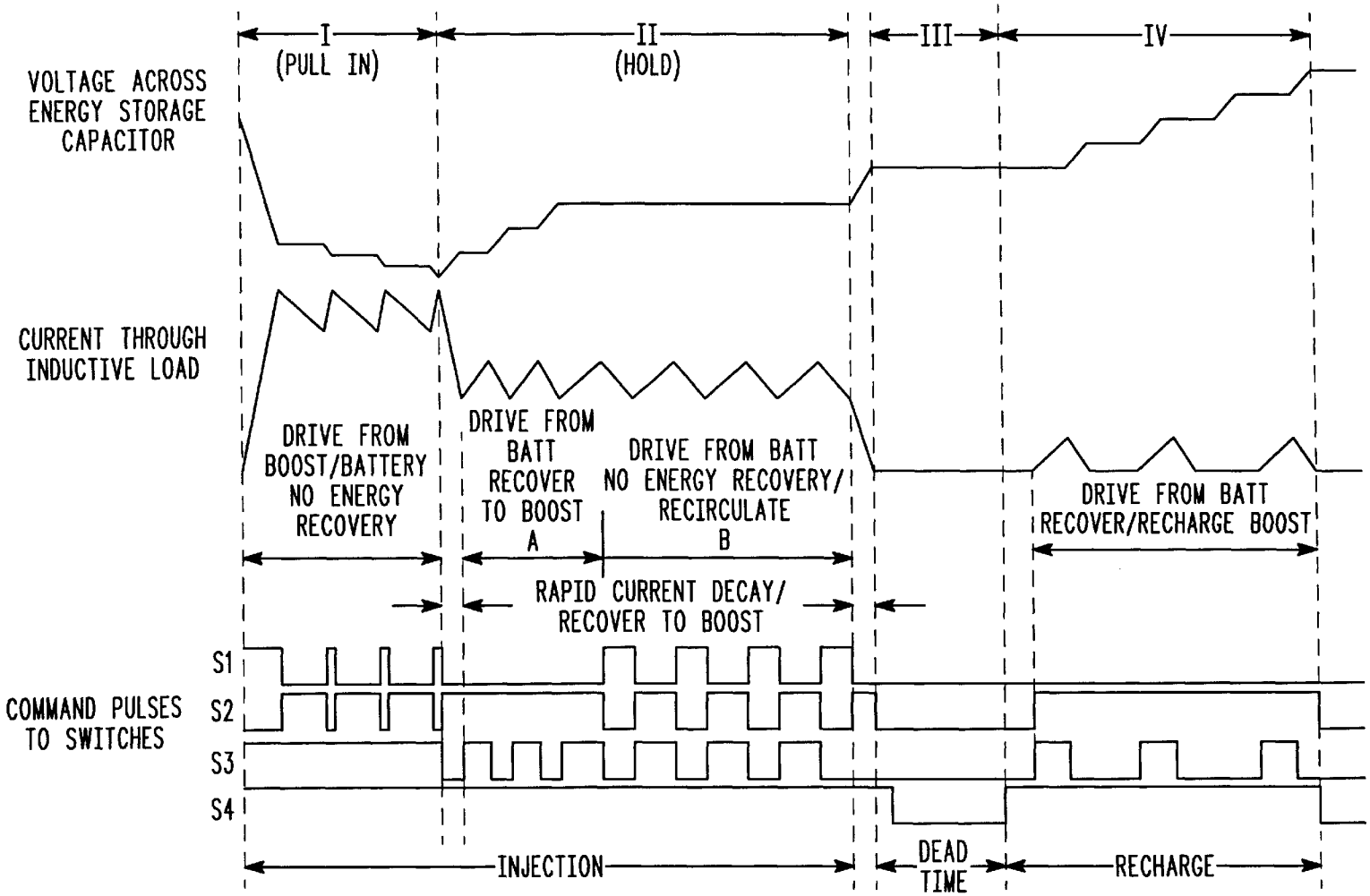
FIG. 22 is a timing diagram for the steps and circuit illustrated in FIGS. 18–21.

After a short dead time as determined by the controller 112 based on engine sensors detection of various parameters of the engine, if the voltage across the capacitor C is not at the desired value, switches S4 and S2 are closed. These switches do not necessarily have to be closed simultaneously. This begins phase IV where the load is driven by the battery while the capacitor is recharged to its original starting voltage. As shown in FIG. 22, switch S3 is open and closed during phase IV so that the capacitor is recharged in a step-like manner. Initializing the charge on the capacitor C is accomplished in the same manner as illustrated in phase IV.

The timing diagram of FIG. 22 shows that the load can be driven from the boost capacitor (C) or from battery (B), and the load current can be recovered to boost or freewheeled. Which portion of the waveform that is driven in each of these manners will depend on boost voltage, battery voltage and any knowledge of the next/previous injection event, etc.

In summary, the circuits 100 of FIGS. 6–24 are operated by having a controller 112 open and close switches S1–S4 based on one or more parameters of the load, such as the load current and boost voltage, that are measured by the detectors 114 and 115, respectively. Since the load is always ground referenced and the capacitor C is not permanently ground referenced, this provides for a simplistic single method of current sense on the low side of the load and allows the load current to be measured unidirectionally at a single point, continuously throughout the cycle. Using a single, ground-based detector 114 provides greater flexibility for current control. Note that the capacitor is switched to ground when energy is transferred from the capacitor to the load and, except for the embodiment of FIGS. 23–24, during slow energy discharge. The ground reference is removed during energy recovery.

In addition, the circuits 100 of FIGS. 6–24 provide an inductive load driver topology that drives the load from battery or from a high voltage to and/or to maintain current levels even at low battery voltages with high load impedance. To minimize power dissipation and the number of components, the energy delivered to the load is recovered and stored for the next cycle. In order to accomplish this task, the capacitor is switched in and out of the circuit to do one of three things: 1) Drive the load to a higher current level, 2) Recover energy from the load, and 3) Freewheel and recirculate the load current for a slow load energy discharge, with no energy transfer to the capacitor.

During the operation of the inductive load drivers 100 as described previously with respect to FIGS. 6–24, it is advantageous to drive the load at the sustaining current levels with the lowest possible system voltage that will maintain load current. An obvious advantage of doing this is to minimize the switching of the drivers, thereby minimizing losses, such as switching losses, and minimizing electromagnetic interference. Furthermore, for the previously described inductive load driver systems, the available system voltage sources are generated from the energy stored in the external system battery B and the internal energy storage capacitor C. If it is at all possible to sustain currents from the external battery, the total internal power dissipations and energy losses will be minimized. This is why the different operating modes as previously described are desirable. However, these different operating modes do not have an inherent capability of self-determining the most suitable operating voltage for the system.

Figure 25A:
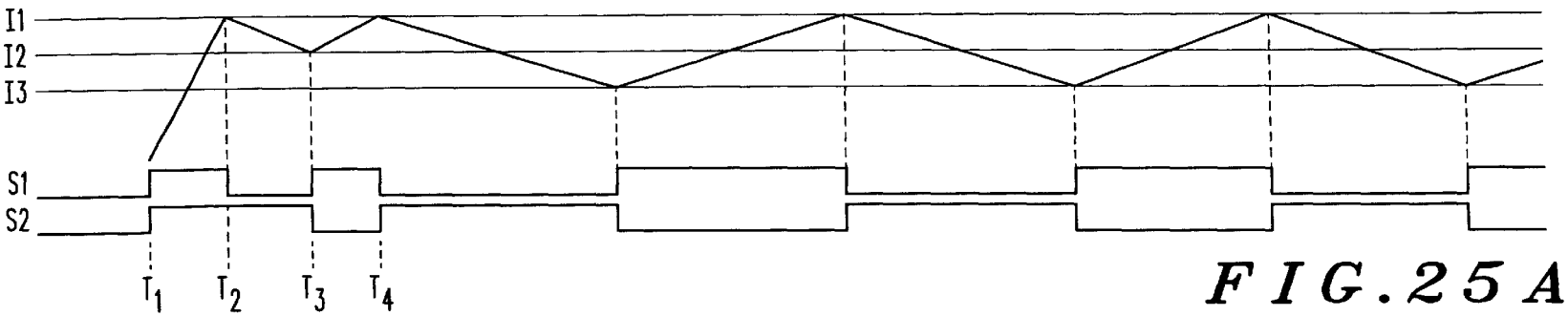
FIG. 25A is a timing diagram illustrating a variation of one of the modes shown in FIGS. 9, 13 and 24.
Figure 25B:
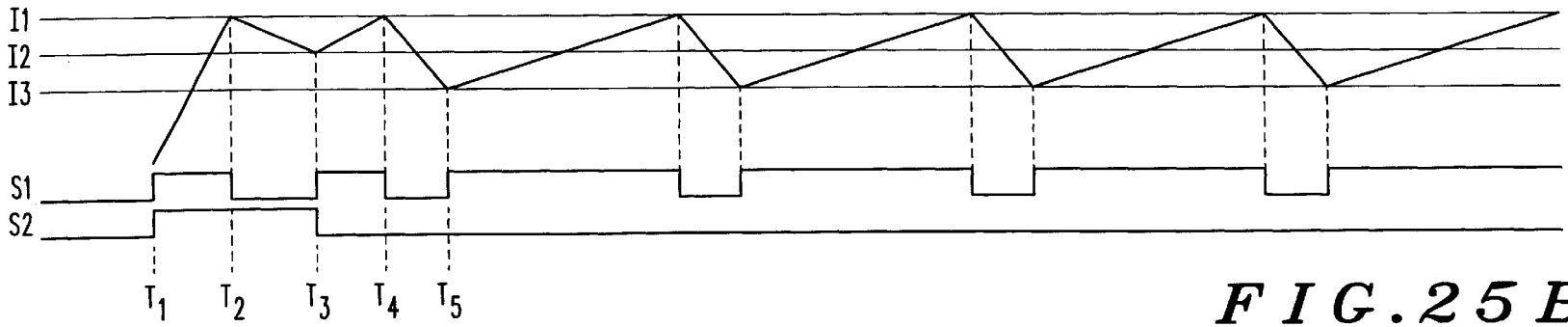
FIG. 25B is a timing diagram illustrating a variation of one of the modes shown in FIGS. 9, 13 and 24.
Figure 25C:
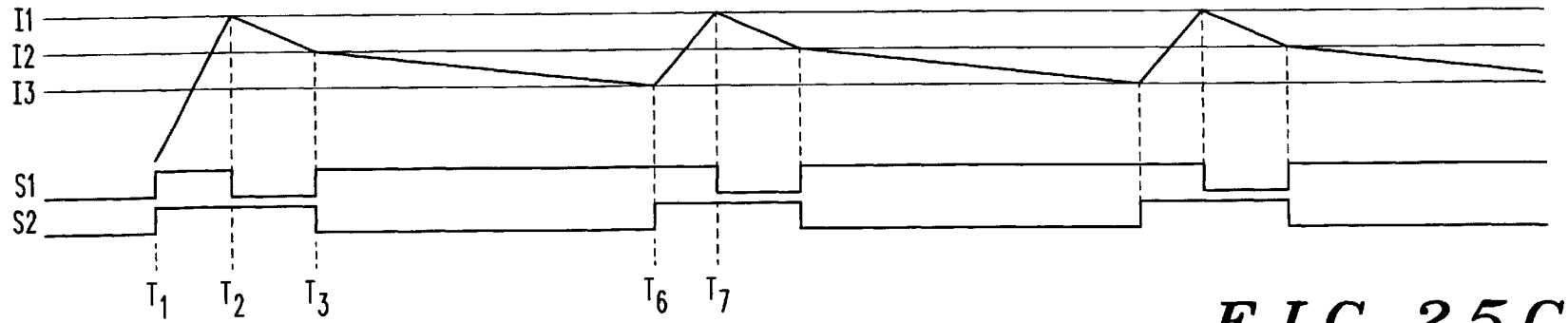
FIG. 25C is a timing diagram illustrating a mode of operation when it is determined in the mode of FIG. 25B that the battery is insufficient to drive the load current to a desired maximum level.

One method of determining the lowest possible operating voltage for the system is illustrated in FIGS. 25A–C. As shown in FIGS. 25A–C, an intermediate threshold load current I2 is established between the peak current I1 and the valley current I3. In the case of the driver 100 of FIG. 8, the switches S1 and S2 are initially closed at T1 by the controller 112 causing the voltage across the capacitor C to be applied to the load L causing the load current to rise to the maximum level I1 at T2. Once the controller 112 determines that the maximum level is reached, the switch S1 is opened at T2 so as to remove the voltage source (capacitor C) from the load L. This results in a freewheel action from the load L until the intermediate threshold current I2 is reached at T3. At this point, the controller 112 conducts a test by opening switch S1 while switch S2 is closed causing the load L to be solely driven by the battery B. If the battery voltage is sufficient to drive the load, the current will again climb back to the maximum current level I1 at T4 as shown in FIGS. 25A and 25B. If the battery B cannot sustain the load L, the current will fall to I3 at T6 as shown in FIG. 25C.

As described above, the intermediate threshold current I2 is used to initiate a battery test at the beginning of a mode of operation. During the battery test, only the battery drives the current by turning off switch S2 at T3 while switch S1 is turned on. If the load current subsequently reaches the load current I1 at T4 that signifies that the voltage of the battery is sufficient and the driver 100 can subsequently implement either a freewheel mode as described above with respect to FIG. 25A or a recover mode as shown in FIG. 25B depending on whether the voltage of the capacitor C at T4 is at a desired level to allow for the current to rise from 0 to I1 amps in the desired time during the next pull-in event. If the voltage of the capacitor is at the desired level at T4, then the freewheel mode of FIG. 25A is implemented. If the capacitor voltage does not reach a sufficient level, then the recover mode of FIG. 25B is implemented which is a variation of the related recover modes of FIGS. 9, 13 and 24. In particular, the recover mode of FIG. 25B is related to mode 2 described previously with respect to FIG. 9. As shown in FIG. 25B, the switch S2 remains open at T4 while the switch S1 is opened until a time T5 where the current falls to the minimum threshold current level I3. At this time, switch S1 is closed and S2 remains open causing the load current to be solely driven by the battery B until the maximum current threshold is reached where the process is repeated.

In either of the modes described above with respect to FIGS. 25A or 25B, should the voltage of the battery B be insufficient so that the load current at T3 cannot be driven back to the maximum threshold current I1, then the load current will fall to the minimum threshold current I3 as shown in FIG. 25C. During the falling of the current from T3 to T6, switch S1 is closed while switch S2 is open causing the load current to be driven solely by the battery. Upon reaching the current I3 at T6, the switch S1 remains closed while switch S2 is closed until the load current is driven by both the capacitor and the battery up to the current I1 at T7. The process from T2 to T7 is then repeated.

The invention may be embodied in other forms than those specifically disclosed herein without departing from its spirit or essential characteristics. The described embodiments are to be considered in all respects only as illustrative and not restrictive, and the scope of the invention is commensurate with the appended claims rather than the foregoing description.

We claim:

1. An inductive load driver comprising:

an inductive load;

a bridge circuit connected in parallel with said inductive load, wherein said bridge circuit generates a current to said inductive load that rises, the bridge circuit having at least one switch;

a detector connected to said inductive load so as to measure a parameter of said inductive load; and a controller that is connected to the at least one switch and the detector, wherein the controller opens or closes the at least one switch based upon the measured parameter of said inductive load.

2. The inductive load driver of claim 1, wherein said inductive load comprises a fuel injector.

3. The inductive load driver of claim 1, wherein a capacitor is located in the middle of said bridge circuit.

4. The inductive load driver of claim 3, wherein the bridge circuit further comprises at least two switches, a first switch and a second switch, the first switch being connected to a first leg of said bridge circuit, the second switch being connected to a second leg of said bridge circuit, wherein said first leg is opposite said second leg.

5. The inductive load driver of claim 4, comprising:

a first diode that is connected to a third leg of said bridge circuit; and a second diode that is connected to a fourth leg of said bridge circuit.

6. The inductive load driver of claim 1, comprising:

an independent voltage source that is connected in parallel to said bridge circuit.

7. The inductive load driver of claim 6, wherein said independent voltage source comprises a battery.

8. The inductive load driver of claim 1, comprising an independent voltage source connected to a first leg of said bridge circuit.

9. The inductive load driver of claim 8, wherein said independent voltage source comprises a battery.

10. The inductive load driver of claim 1, wherein said generated current rises to a peak value in less than 200 $\mu$s.

11. The inductive load driver of claim 4, wherein the controller is connected to said first switch, said second switch and said detector, wherein said controller opens or closes said first and second switches based upon said measured parameter of said inductive load.

12. The inductive load driver of claim 4, further comprising:

a capacitor that is located in the middle of said bridge circuit; and a second detector that is connected to said capacitor so as to measure a parameter of said capacitor;

wherein the controller is connected to said first switch, said second switch and said second detector, wherein said controller opens or closes said first and second switches based upon said measured parameter of said capacitor.

13. The inductive load driver of claim 11, further comprising:

a capacitor is located in the middle of said bridge circuit; and a second detector that is connected to said capacitor so as to measure a parameter of said capacitor;

wherein said controller opens or closes said first and second switches based upon said measured parameter of said capacitor.

14. An inductive load driver comprising:

a bridge circuit;

an inductive load connected in parallel with said bridge circuit, wherein said load is always directly or indirectly ground referenced; and a detector connected to said inductive load so as to measure a parameter of said load continuously.

15. The inductive load driver of claim 14, wherein said inductive load comprises a fuel injector.

16. The inductive load driver of claim 14, wherein a capacitor is located in the middle of said bridge circuit.

17. The inductive load driver of claim 16, comprising:

a first switch that is connected to a first leg of said bridge circuit; and a second switch that is connected to a second leg of said bridge circuit, wherein said first leg is opposite said second leg.

18. The inductive load driver of claim 17, comprising:

a first diode that is connected to a third leg of said bridge circuit; and a second diode that is connected to a fourth leg of said bridge circuit.

19. The inductive load driver of claim 14, wherein said parameter is the current flowing through said load.

20. The inductive load driver of claim 17, comprising:

a detector connected to said load so as to measure a parameter of said load; and a controller that is connected to said first switch, said second switch and said detector, wherein said controller opens or closes said first and second switches based upon said measured parameter.

21. The inductive load driver of claim 17, comprising:

a detector connected to said capacitor so as to measure a parameter of said capacitor; and a controller that is connected to said first switch, said second switch and said detector, wherein said controller opens or closes said first and second switches based upon said measured parameter.

22. The inductive load driver of claim 21, comprising:

a detector connected to said capacitor so as to measure a parameter of said capacitor; and wherein said controller opens or closes said first and second switches based upon said measured parameter of said capacitor.

23. The inductive load driver of claim 14, comprising:

an independent voltage source that is connected in parallel to said bridge circuit.

24. The inductive load driver of claim 23, wherein said independent voltage source comprises a battery.

25. An inductive load driver comprising:

an inductive load;

a bridge circuit comprising an energy storage element and at least one switch, wherein said bridge circuit is connected in parallel with said inductive load and said energy storage element is not permanently ground referenced;

a detector connected to said inductive load so as to measure a parameter of said inductive load; and a controller that is connected to the at least one switch and the detector, wherein the controller opens and closes the at least one switch based upon the measured parameter of said inductive load.

26. The inductive load driver of claim 25, wherein said inductive load comprises a fuel injector.

27. The inductive load driver of claim 25, wherein said energy storage element comprises a capacitor.

28. The inductive load driver of claim 25, wherein said energy storage element is located in the middle of said bridge circuit.

29. The inductive load driver of claim 28, wherein said energy storage element comprises a capacitor.

30. The inductive load driver of claim 28, wherein the bridge circuit further comprises at least two switches, a first switch and a second switch, the first switch being connected to a first leg of said bridge circuit, the second switch being connected to a second leg of said bridge circuit, wherein said first leg is opposite said second leg.

31. The inductive load driver of claim 30, comprising:

a first diode that is connected to a third leg of said bridge circuit; and a second diode that is connected to a fourth leg of said bridge circuit.

32. The inductive load driver of claim 25, comprising:

a detector connected to said load so as to measure a parameter of said load continuously.

33. The inductive load driver of claim 32, wherein said parameter is the current flowing through said load.

34. The inductive load driver of claim 30, wherein the controller is connected to said first switch, said second switch and said detector, wherein said controller opens or closes said first and second switches based upon said measured parameter of said inductive load.

35. The inductive load driver of claim 30, further comprising:

a second detector that is connected to said energy storage element so as to measure a parameter of said energy storage element;

wherein the a controller is connected to said first switch, said second switch and said second detector, wherein said controller opens or closes said first and second switches based upon said measured parameter of said energy storage element.

36. The inductive load driver of claim 34, comprising:

a second detector that is connected to said energy storage element so as to measure a parameter of said energy storage element;

wherein said controller opens or closes said first and second switches based upon said measured parameter of said energy storage element.

37. The inductive load driver of claim 29, comprising:

an independent voltage source that is connected in parallel to said bridge circuit.

38. The inductive load driver of claim 37, wherein said independent voltage source comprises a battery.

39. A method of driving an inductive load that is connected to a bridge circuit, the bridge circuit having at least one switch and a capacitor, the method comprising steps of:

charging said capacitor with a charge;

measuring a parameter of said inductive load; and controlling the opening and closing of the at least one switch of said bridge circuit based on the measured parameter of said inductive load so that said charge is dissipated from said capacitor so as to create a first current that drives said inductive load, wherein said inductive load is connected in parallel with said bridge circuit.

40. The method of claim 39 wherein said inductive load comprises a fuel injector.

41. The method of claim 39, comprising controlling the bridge circuit so that said inductive load discharges a charge onto said capacitor.

42. The method of claim 39, comprising controlling the bridge circuit so that said inductive load slowly discharges current with no energy transfer between said inductive load and said capacitor.

43. The method of claim 39, wherein the inductive load is always directly or indirectly ground referenced.

44. The method of claim 39, comprising connecting an independent voltage source to said inductive load so that a second current drives said inductive load.

45. The method of claim 44, wherein said second current is different in magnitude than said first current.

46. The method of claim 39, wherein said first current rises.

47. The method of claim 46, wherein said first current rises to a peak value in less than 200 $\mu$s.

48. The method of claim 39, comprising:

measuring a parameter of said capacitor; and performing said controlling of the opening and closing of the at least one switch of said bridge circuit based upon the value of said measured parameter of said capacitor.

49. The method of claim 42, comprising:

measuring a parameter of said capacitor; and performing said controlling of the opening and closing of the at least one switch of said bridge circuit so that said inductive load discharges a charge onto said capacitor based upon the value of said measured parameter of said capacitor.

50. The method of claim 42, comprising:

performing said controlling of the opening and closing of the at least one switch of said bridge circuit so that said inductive load slowly discharges its stored energy with no energy transfer between said inductive load and said capacitor based upon the value of said measured parameter of said inductive load.

51. The method of claim 42, comprising:

measuring a parameter of said capacitor; and performing said controlling of the opening and closing of the at least one switch of said bridge circuit so that said inductive load slowly discharges its stored energy with no energy transfer between said inductive load and said capacitor based upon the value of said measured parameter of said capacitor.

52. The method of claim 50, comprising:

measuring a parameter of said capacitor; and performing said controlling of the opening and closing of the at least one switch of said bridge circuit so that said inductive load slowly discharges its stored energy with no energy transfer between said inductive load and said capacitor based upon the value of said measured parameter of said capacitor.

53. A method of driving an inductive load that is connected to a capacitor and a battery comprising:

driving a current through said inductive load from a first current value to a second current value, wherein said second current value is greater than said first current value;

decreasing the current through said inductive load from said second current value to a third current value, wherein said third current value is greater than said first current value; and determining whether or not said battery can drive said current from said third current value to said second current value.

54. The method of claim 53, wherein if it is determined that said battery can drive said current from said third current value to said second current value, then said load is freewheeled when said current reaches said second current value.

55. The method of claim 53, wherein if it is determined that said battery can drive said current from said third current value to said second current value, then said load is recovered w hen said current reaches said second current value.

56. The method of claim 53, wherein if it is determined that said battery cannot drive said current from said third current value to said second current value, then said current will fall to said first current value at which point said current is driven by both said capacitor and said battery.

57. The method of claim 53, comprising:

determining whether or not said capacitor has a voltage that is at least a predetermined value.

58. The method of claim 57, wherein if it is determined that said battery can drive said current from said third current value to said second current value and said capacitor has a voltage that is at least said predetermined voltage, then said load is freewheeled when said current reaches said second current level.

59. The method of claim 57, wherein if it is determined that said battery can drive said current from said third current value to said second current value and said capacitor has a voltage that is less than said predetermined voltage, then said load is recovered when said current reaches said second current level.

60. The method of claim 53, wherein said inductive load is connected in parallel to a bridge circuit.

61. The method of claim 53, wherein said inductive load comprises a fuel injector.

62. The method of claim 60, wherein said inductive load comprises a fuel injector.

63. The method of claim 60, wherein said capacitor is located in the middle of said bridge circuit.

64. The method of claim 63, wherein said bridge circuit comprises:

a first switch that is connected to a first leg of said bridge circuit; and a second switch that is connected to a second leg of said bridge circuit, wherein said first leg is opposite said second leg.

65. An inductive load driver comprising:

an inductive load;

a bridge circuit connected in parallel with said inductive load, wherein said bridge circuit generates a current to said inductive load that rises, the bridge circuit having at least one switch and an energy storage element;

a detector connected to said energy storage element so as to measure a parameter of said energy storage element; and a controller that is connected to the at least one switch and the detector, wherein the controller opens or closes the at least one switch based upon the measured parameter of said energy storage element.

66. The inductive load driver of claim 65, wherein the energy storage element comprises a capacitor that is located in the middle of said bridge circuit.

67. The inductive load driver of claim 65, wherein the bridge circuit further comprises at least two switches, a first switch and a second switch, the first switch being connected to a first leg of said bridge circuit, the second switch being connected to a second leg of said bridge circuit, wherein said first leg is opposite said second leg.

68. The inductive load driver of claim 67, further comprising:

a first diode that is connected to a third leg of said bridge circuit; and a second diode that is connected to a fourth leg of said bridge circuit.

69. The inductive load driver of claim 65, further comprising:

an independent voltage source that is connected in parallel to said bridge circuit.

70. The inductive load driver of claim 65, further comprising an independent voltage source that is connected to a first leg of said bridge circuit.

71. The inductive load driver of claim 67, wherein the controller is connected to said first switch, said second switch and said detector; and wherein said controller opens or closes said first and second switches based upon said measured parameter of said energy storage element.

72. The inductive load driver of claim 67, further comprising:

a second detector that is connected to said inductive load so as to measure a parameter of said inductive load;

wherein the controller is connected to said first switch, said second switch and said second detector, wherein said controller opens or closes said first and second switches based upon said measured parameter of said inductive load.

73. An inductive load driver comprising:

an inductive load;

a bridge circuit comprising an energy storage element and at least one switch, wherein said bridge circuit is connected in parallel with said inductive load and said energy storage element is not permanently ground referenced;

a detector connected to said energy storage element so as to measure a parameter of said energy storage element; and a controller that is connected to the at least one switch and the detector, wherein the controller opens and closes the at least one switch based upon the measured parameter of said energy storage element.

74. The inductive load driver of claim 73, wherein said energy storage element comprises a capacitor that is located in the middle of said bridge circuit.

75. The inductive load driver of claim 73, wherein the bridge circuit further comprises at least two switches, a first switch and a second switch, the first switch being connected to a first leg of said bridge circuit, the second switch being connected to a second leg of said bridge circuit, wherein said first leg is opposite said second leg.

76. The inductive load driver of claim 75, further comprising:

a first diode that is connected to a third leg of said bridge circuit; and a second diode that is connected to a fourth leg of said bridge circuit.

77. The inductive load driver of claim 75, further comprising:

a second detector connected to said inductive load so as to measure a parameter of said inductive load continuously.

78. The inductive load driver of claim 77, wherein the controller is connected to said first switch, said second switch and said detector, wherein said controller opens or closes said first and second switches based upon said measured parameter of said inductive load.

79. A method of driving an inductive load that is connected to a bridge circuit, the bridge circuit having at least one switch and a capacitor, the method comprising steps of:

charging said capacitor with a charge;

measuring a parameter of said capacitor; and controlling the opening and closing of the at least one switch of said bridge circuit based on the measured parameter of said capacitor so that said charge is dissipated from said capacitor so as to create a first current that drives said inductive load, wherein said inductive load is connected in parallel with said bridge circuit.

80. The method of claim 79, further comprising the steps of:

measuring a parameter of said inductive load; and performing said controlling of the opening and closing of the at least one switch of said bridge circuit based upon the value of said measured parameter of said inductive load.

* * * * *